US010678180B2

(12) United States Patent
Nemoto

(10) Patent No.: US 10,678,180 B2
(45) Date of Patent: Jun. 9, 2020

(54) IMAGE FORMING APPARATUS HAVING FUNCTION FOR DETECTING SHEET CONVEYANCE DELAY

(71) Applicant: CANON KABUSHIKI KAISHA, Tokyo (JP)

(72) Inventor: Yusuke Nemoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 15/912,889

(22) Filed: Mar. 6, 2018

(65) Prior Publication Data

US 2018/0275590 A1 Sep. 27, 2018

(30) Foreign Application Priority Data

Mar. 22, 2017 (JP) ..... 2017-056460

(51) Int. Cl.
*G03G 15/00* (2006.01)
*G03G 21/14* (2006.01)

(52) U.S. Cl.
CPC ..... *G03G 15/70* (2013.01); *G03G 15/5029* (2013.01); *G03G 15/6564* (2013.01); *G03G 2215/00476* (2013.01); *G03G 2215/00548* (2013.01); *G03G 2215/00599* (2013.01); *G03G 2215/00742* (2013.01)

(58) Field of Classification Search
CPC ..... G03G 15/00; G03G 15/70; G03G 21/14; G03G 2215/00476; G03G 2215/00548; G03G 2215/00599; G03G 2215/00742
See application file for complete search history.

(56) References Cited

FOREIGN PATENT DOCUMENTS

| | | | | | |
|---|---|---|---|---|---|
| JP | 2006188359 | A | * | 7/2006 | ..... G03G 15/00 |
| JP | 2006298606 | A | * | 11/2006 | ..... G03G 15/00 |
| JP | 2007155763 | A | * | 6/2007 | ..... G03G 21/14 |
| JP | 2015-014695 | A | | 1/2015 | |
| JP | 2018008827 | A | * | 1/2018 | ..... G03G 15/00 |

* cited by examiner

*Primary Examiner* — Nguyen Q. Ha
(74) *Attorney, Agent, or Firm* — Venable LLP

(57) ABSTRACT

An image forming apparatus comprises a container, a supplier, a conveyor, a grammage detector, a sheet detector, an image former, and a processor. The processor sets a flag when the detected grammage exceeds a first grammage, measures a conveyance time of a sheet to the sheet detector, determines a conveyance delay of the sheet based on whether the conveyance time is greater than or equal to a first amount of time, counts a number of occurrences of the conveyance delay in a state where the detected grammage exceeds the first grammage, and prohibits supply of sheets from the container when the detected grammage exceeds a second grammage larger than the first grammage or the number of occurrences of the conveyance delay is greater than or equal to a threshold value.

12 Claims, 11 Drawing Sheets

THERE IS POSSIBILITY THAT
THE SHEET CONTAINED IN FEED CASSETTE
IS OF A TYPE THAT IS NOT SUPPORTED.

PRINTING IS NOT POSSIBLE
BECAUSE THERE IS POSSIBILITY THAT THE SHEET
WILL BE JAMMED IN CONVEYANCE PATH.

OK

IN CASE OF THIN PAPER

IN CASE OF THICK PAPER

FIG. 11A

THERE IS POSSIBILITY THAT
THE SHEET CONTAINED IN FEED CASSETTE
IS OF A TYPE THAT IS NOT SUPPORTED.

PRINTING IS NOT POSSIBLE
BECAUSE THERE IS POSSIBILITY THAT THE SHEET
WILL BE JAMMED IN CONVEYANCE PATH.

OK

FIG. 11B

PAPER JAM OCCURRED IMMEDIATELY
AFTER FEEDING FROM SHEET FEED CASSETTE.

PLEASE REMOVE JAMMED PAPER.

OK

IMAGE FORMING APPARATUS HAVING FUNCTION FOR DETECTING SHEET CONVEYANCE DELAY

BACKGROUND OF THE INVENTION

Field of the Invention

The present invention relates to an image forming apparatus having a function for detecting a sheet conveyance delay.

Description of the Related Art

An image forming apparatus for controlling a condition for image forming in accordance with a type of sheet detected by a media sensor is known (Japanese Patent Laid-Open No. 2015-14695). An electronic photographic method image forming apparatus controls a fixing temperature in accordance with a type of a sheet. An ink-jet method image forming apparatus controls a total amount of ink for a pixel in accordance with the type of a sheet.

When a sheet that is extremely thick is detected by a media sensor, an image forming apparatus may prohibit supply of a subsequent sheet from a feed cassette. This is to suppress jamming of the sheet. However, because there is variation in media sensor detection results, there is a possibility that supply will sometimes be prohibited even in the case of a sheet that can be conveyed.

SUMMARY OF THE INVENTION

The present invention improves the accuracy of sheet supply control in accordance with the type of a sheet.

The present invention provides an image forming apparatus comprising: a container configured to contain sheets; a supplier configured to supply a sheet contained in the container to a conveyance path; a conveyor configured to convey the sheet in the conveyance path; a grammage detector configured to detect a grammage of the sheet conveyed in the conveyance path; a sheet detector configured to detect the sheet at a predetermined position in the conveyance path; an image former configured to form an image on the sheet; and at least one processor, wherein the at least one processor includes: a function for setting a flag in a case where the grammage detected by the grammage detector exceeds a first grammage, a function for measuring a conveyance time of the sheet to the sheet detector, a function for determining a conveyance delay of the sheet based on whether the conveyance time is greater than or equal to a first amount of time, a function for counting a number of occurrences of the conveyance delay in a state where the grammage detected by the grammage detector exceeds the first grammage, and a function for prohibiting supply of sheets from the container when the grammage exceeds a second grammage larger than the first grammage or the number of occurrences of the conveyance delay is greater than or equal to a threshold value.

Further features of the present invention will become apparent from the following description of exemplary embodiments (with reference to the attached drawings).

BRIEF DESCRIPTION OF THE DRAWINGS

FIGS. 11A and 11B are views for illustrating notifications to an operator.

DESCRIPTION OF THE EMBODIMENTS

In the present embodiment, when a sheet for which there is a high possibility for a jam to occur is detected by a media sensor, sheet supply is continued by postponing prohibition of subsequent sheet supply. This is because it is possible that a sheet for which a jam could occur was mistakenly detected due to detection variation of the media sensor. However, when a sheet conveyance delay occurs frequently, supply of a subsequent sheet is prohibited. Accordingly, accuracy of sheet supply control in accordance with the type of a sheet detected by the media sensor is improved.

<Image Forming Apparatus>

Figure 1:
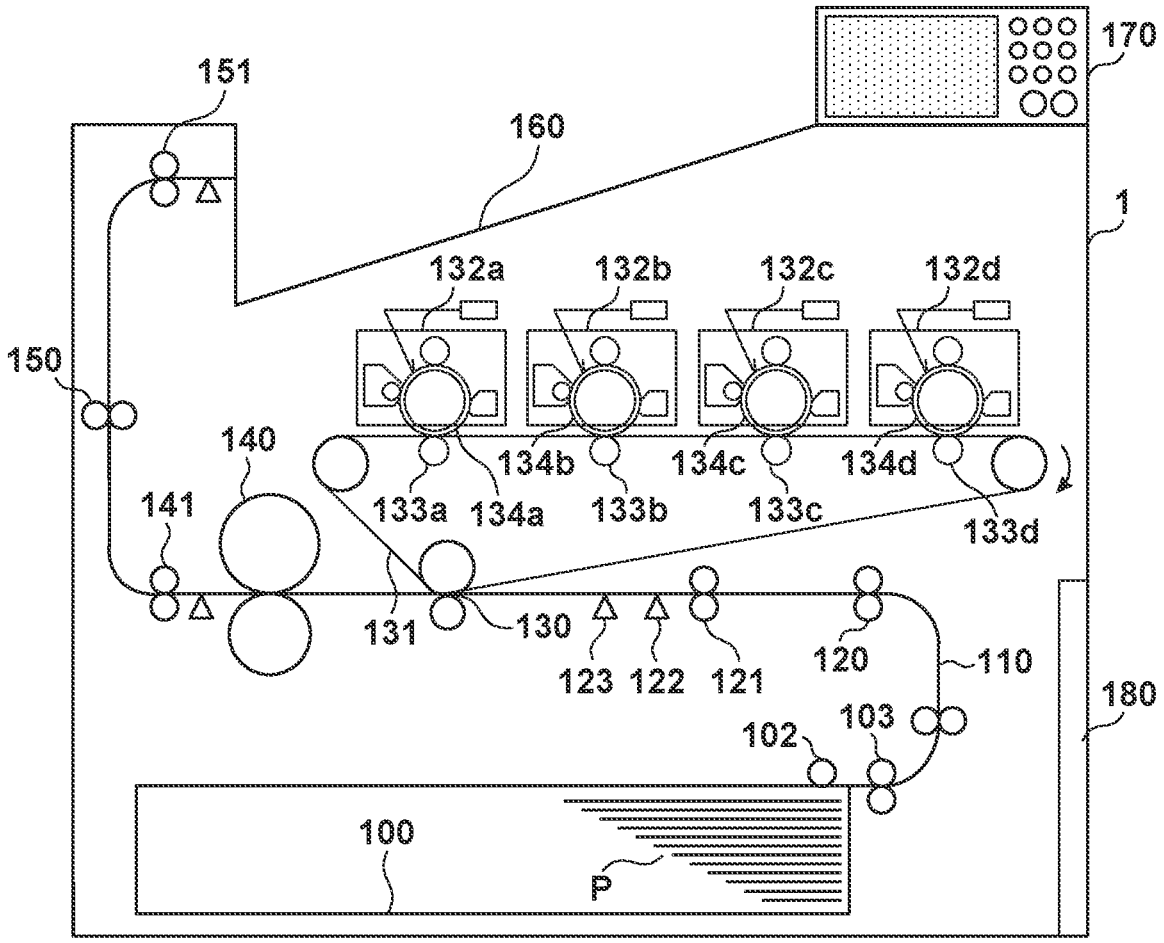
FIG. 1 is a cross-sectional view of an image forming apparatus.
Figure 2:
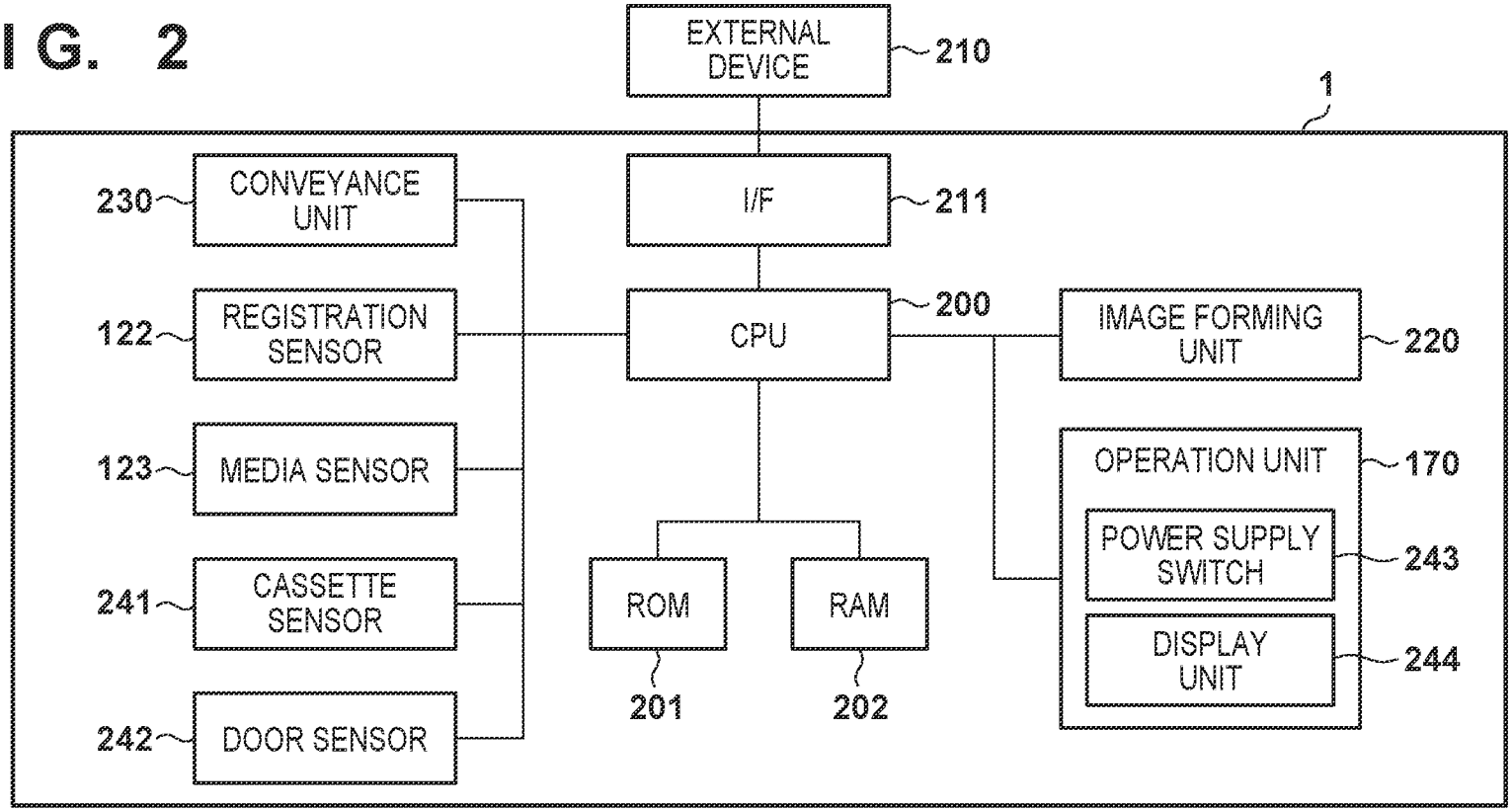
FIG. 2 is a view that illustrates a control unit.

Description is given for an image forming apparatus 1 while referring to FIG. 1 and FIG. 2. Explanation is given for the image forming apparatus 1, which is of an electronic photographic method, but the technical concept of the present invention can also be applied to other image forming apparatuses, such as that of an ink-jet method. In other words, the present invention can be applied in the case of an image forming apparatus that uses a media sensor to detect the type of the sheet and controls a condition for image forming or the like in accordance with the detected type.

The image forming apparatus 1 has one or more sheet feed cassettes 100. A pickup roller 102 picks up a sheet P contained in a sheet feed cassette 100 and feeds it to a conveyance path 110. Note that a separate cassette may be optionally added. A separation roller 103 is a conveyance roller for, when a plurality of sheets P are fed together, separating the highest sheet P from the other sheets P and conveying it to a downstream side. A pre-registration roller 120 provided on the downstream side of the separation roller 103 is a conveyance roller for further conveying the sheet P to a downstream side. A registration roller 121 provided on a downstream side of the pre-registration roller 120 is a conveyance roller for further conveying the sheet P to a downstream side. A registration sensor 122 provided on the downstream side of the registration roller 121, in a time period from when a leading edge of the sheet P is detected until a trailing edge thereof is detected, outputs a signal indicating that the sheet P is passing through. Note that a conveyance time from when driving of the pickup roller 102 is instructed until the registration sensor 122 detects the leading edge of the sheet P is monitored in order to detect a jam or a conveyance delay. A media sensor 123 which is on a downstream side of the registration sensor 122 and an upstream side of a secondary transfer unit 130 is provided. The media sensor 123 detects a property parameter of the sheet P. The property parameter is a parameter that influences conveyance accuracy of the sheet P, such as a grammage or a thickness. For example, when the grammage of the sheet P is large, it is easy for a conveyance delay or a jam to occur for the sheet P. In addition, a condition for image forming such as a fixing temperature or a conveyance speed changes in accordance with the grammage.

The image forming apparatus 1 starts image formation by cartridges 132*a* through 132*d* in synchronization with a timing at which the sheet P reaches the secondary transfer unit 130. A character added to the end of a reference numeral indicates a toner color. "a" indicates yellow, "b" indicates magenta, "c" indicates cyan, and "d" indicates black. The character indicating a color is omitted when a matter common to each color is described.

A cartridge 132 has a photosensitive drum 134 for carrying and conveying an electrostatic latent image or a toner image. The cartridge 132 forms an electrostatic latent image by charging the photosensitive drum 134 to a uniform potential and exposing the photosensitive drum 134 in accordance with an image signal, and further forms a toner image by using toner to develop the electrostatic latent image. For a primary transfer unit 133, a primary transfer voltage is applied. By this, the toner image on the photosensitive drum 134 is transferred onto an intermediate transfer belt 131. The intermediate transfer belt 131 rotates to convey the toner image to the secondary transfer unit 130.

The registration roller 121 conveys the sheet P to the secondary transfer unit 130 at a timing that is synchronized with the toner image on the intermediate transfer belt 131. The secondary transfer unit 130 transfers the toner image to the sheet P by applying a secondary transfer voltage to the sheet P. A fixing apparatus 140 fixes the toner image to the sheet P by applying heat and temperature to the sheet P conveyed from the secondary transfer unit 130. A fixing conveyance roller 141 conveys to a downstream side the sheet P conveyed from the fixing apparatus 140, and transfers it to a vertical path roller 150. The vertical path roller 150 transfers the sheet P conveyed from the fixing conveyance roller 141 to a discharge roller 151. The discharge roller 151 discharges the sheet P to a sheet discharge tray 160. The image forming apparatus 1 accepts an instruction from an operator through an operation unit 170, and outputs, for example, a notification such as the occurrence of a jam or prohibition of feeding. A maintenance door 180 is a door that opens in order for an operator to remove a sheet P that has jammed in a sheet feeding unit. Note that a post-processing apparatus for performing post-processing on a sheet may be optionally connected to a left side of the image forming apparatus 1 in FIG. 1 via a conveyance path that branches from the conveyance path on the downstream side from the fixing conveyance roller 141.

<Control Unit>

FIG. 2 illustrates a control unit of the image forming apparatus 1. A CPU 200 is a controller for comprehensively controlling each unit of the image forming apparatus 1. For example, the CPU 200 controls an image forming unit 220, a conveyance unit 230, or the like. The image forming unit 220 is the cartridge 132, the fixing apparatus 140, or the like which are described above. The conveyance unit 230 has, for example, a motor and a driving circuit for driving various rollers such as the pickup roller 102 or the registration roller 121. The CPU 200 uses a detection result by the registration sensor 122 or the media sensor 123 to control feeding and conveyance of the sheet P, and control a fixing temperature of the fixing apparatus 140. Functions of the CPU 200 described below are realized by executing a control program stored in a ROM 201. However some or all functions may be realized by hardware such as an ASIC or an FPGA. ASIC is an abbreviation for application specific integrated circuit. FPGA is an abbreviation for field-programmable gate array. The CPU 200 communicates with an external device 210 such as a personal computer via an I/F 211 which is a USB cable or the like. For example, the CPU 200 receives printing information from the external device 210, and stores the printing information in a RAM 202.

The CPU 200 uses a cassette sensor 241 to recognize opening and closing of the sheet feed cassette 100. The sheet feed cassette 100 is opened and closed when an operator replenishes sheets P or changes the type of the sheets P. The CPU 200 uses a door sensor 242 to detect opening and closing of the maintenance door 180. Upon detecting a jam, the CPU 200 displays a notification (message) indicating that a jam has occurred on a display unit 244 of the operation unit 170. This notification may be outputted in accordance with audio, and may be outputted as an electronic mail. An operator opens the maintenance door 180, removes a sheet P that jammed, and closes the maintenance door 180 again. When a power supply switch 243 provided on the operation unit 170 is operated, the CPU 200 shuts down the image forming apparatus 1.

Figure 3:
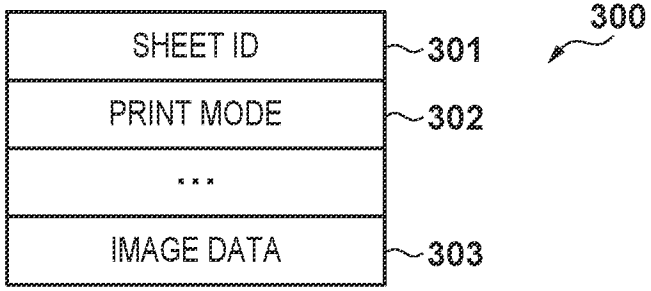
FIG. 3 is a view that illustrates printing information.

FIG. 3 illustrates printing information 300. The external device 210 generates and transmits printing information for each page. The CPU 200 controls the image forming unit 220 or the conveyance unit 230 in accordance with the printing information 300. A sheet ID 301 is identification information for identifying respective sheets, and is allocated to each sheet. A print mode 302 is information for designating control details in accordance with a type of a sheet. For example, there are an auto-detect mode, a designation mode, or the like as the print mode 302. The auto-detect mode is a mode in which the type of the sheet P is detected by the media sensor 123. The designation mode is a mode in which an operator designates a type (thin paper, normal paper, thick paper 1, thick paper 2, or the like) of a sheet P. Image data 303 is data of an image to be printed to the sheet P.

<Media Sensor>

Figure 4:
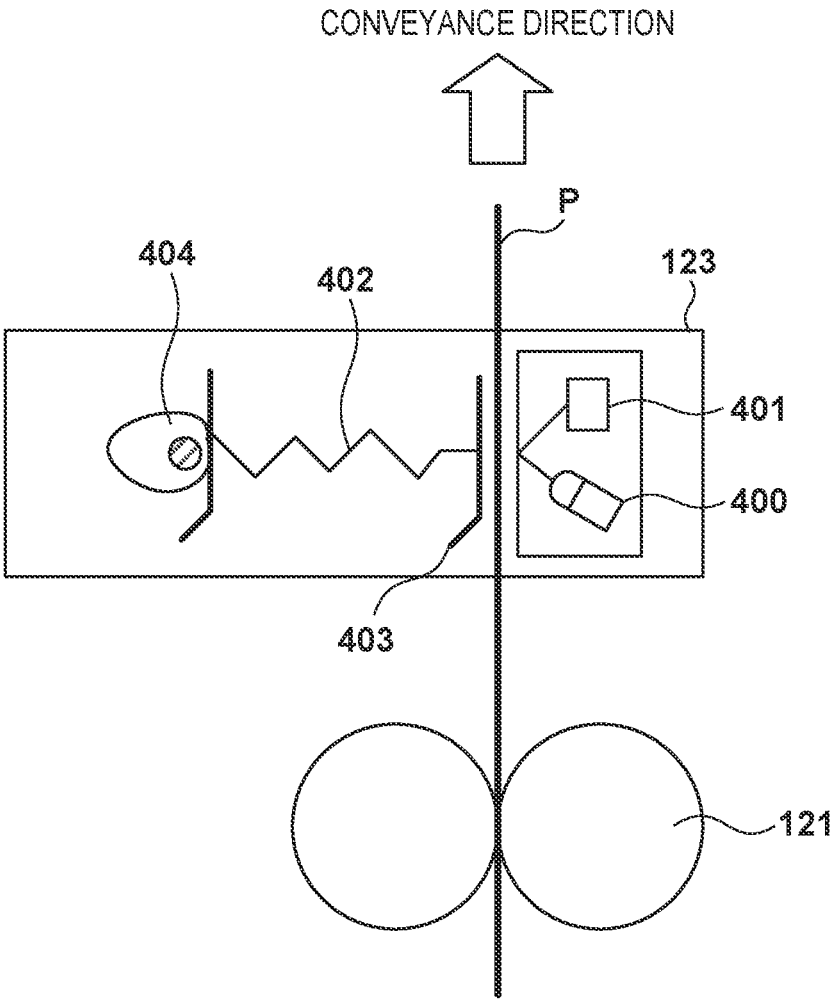
FIG. 4 is a view for describing a configuration of a media sensor.

FIG. 4 illustrates a configuration of the media sensor 123. It is sufficient if the media sensor 123 is a sensor that can detect a property parameter of the sheet P, and for example the media sensor 123 may be a sensor that uses a piezoelectric element or an ultrasonic sensor, and may be a sensor of another method.

An LED 400 and a photodiode 401 are provided inside the media sensor 123. The LED 400 is a light emission device for outputting light. The photodiode 401 is a light receiving element for outputting a signal in accordance with an amount of received light. An optical axis of the LED 400 and an optical axis of the photodiode 401 are positioned so that light emitted by the LED 400 reflects on a surface of the sheet P and is incident on the photodiode 401. A guide portion 403 is a member for regulating a passage position of the sheet P which enters the media sensor 123. The guide portion 403 is biased by a biasing mechanism configured by a spring 402 and a cam 404. By the cam 404 rotating, the biasing force of the spring 402 changes. In other words a force by which the guide portion 403 presses the sheet P also changes. When the orientation of the cam 404 is the orientation illustrated in FIG. 4, a distance from a cam axis to a cam surface which is in contact with the spring 402 is shortest. Accordingly, the length of the spring 402 is longest and the biasing force of the spring 402 is weakest. When the cam 404 rotates a further 180°, a distance from a cam axis to a cam surface which is in contact with the spring 402 is longest. Accordingly, the biasing force of the spring 402 becomes strongest. The CPU 200 causes the cam 404 to rotate in a time period for detecting the grammage of a sheet P to thereby cause the biasing force of the spring 402 to change.

Figure 5A:
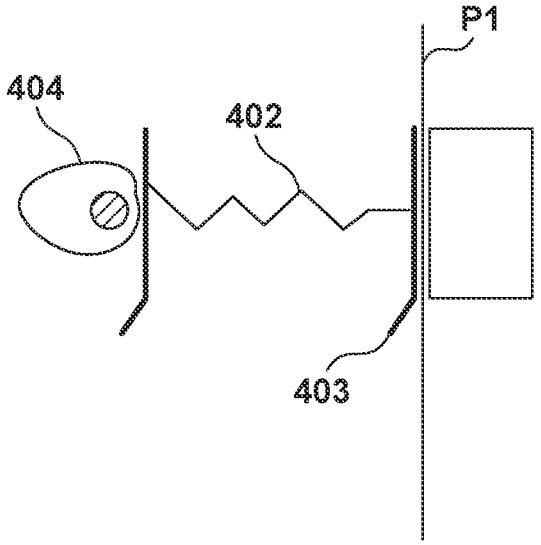
FIGS. 5A to 5D are views for describing a detection operation of a media sensor.
Figure 5B:
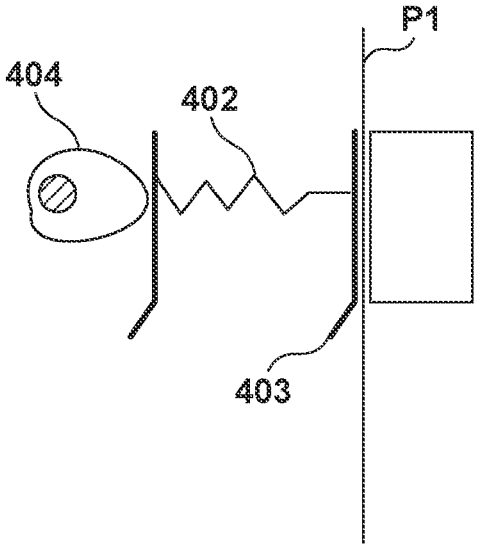
Figure 5C:
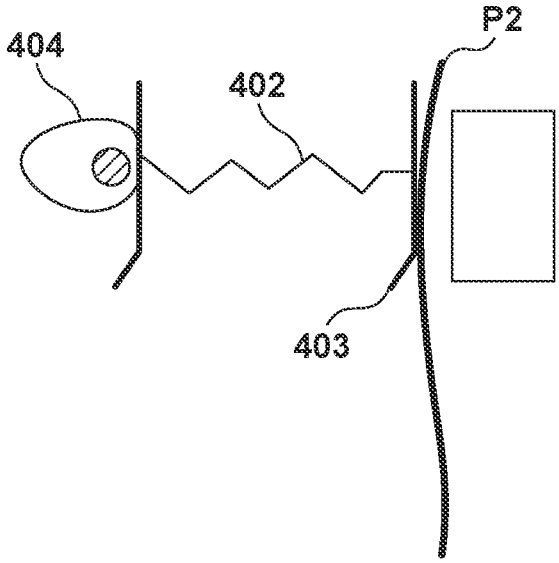
Figure 5D:
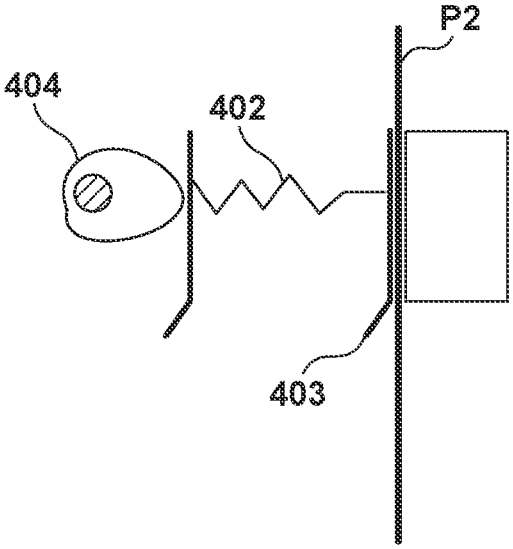

FIG. 5A illustrates a conveyance state the thin paper P1 when the biasing force of the spring 402 is comparatively weak (a first biasing force). FIG. 5B illustrates a conveyance state the thin paper P1 when the biasing force of the spring 402 is comparatively strong (a second biasing force). When the sheet P is the thin paper P1, the thin paper P1 is conveyed in a stable state with respect to the guide portion 403, irrespective of change of the biasing force. In contrast, FIG. 5C illustrates a conveyance state of the thick paper P2 when the biasing force of the spring 402 is weak. FIG. 5D illustrates a conveyance state of the thick paper P2 when the biasing force is strong. As illustrated by FIG. 5C, in a state where the sheet P is the thick paper P2 and the biasing force is weak, the thick paper P2 which has strong resilience presses up the guide portion 403. Meanwhile, in a state where the biasing force is strong as illustrated by FIG. 5D, the thick paper P2 is pressed by the guide portion 403 and the biasing force of the spring 402, and is conveyed stably.

Figure 6A:
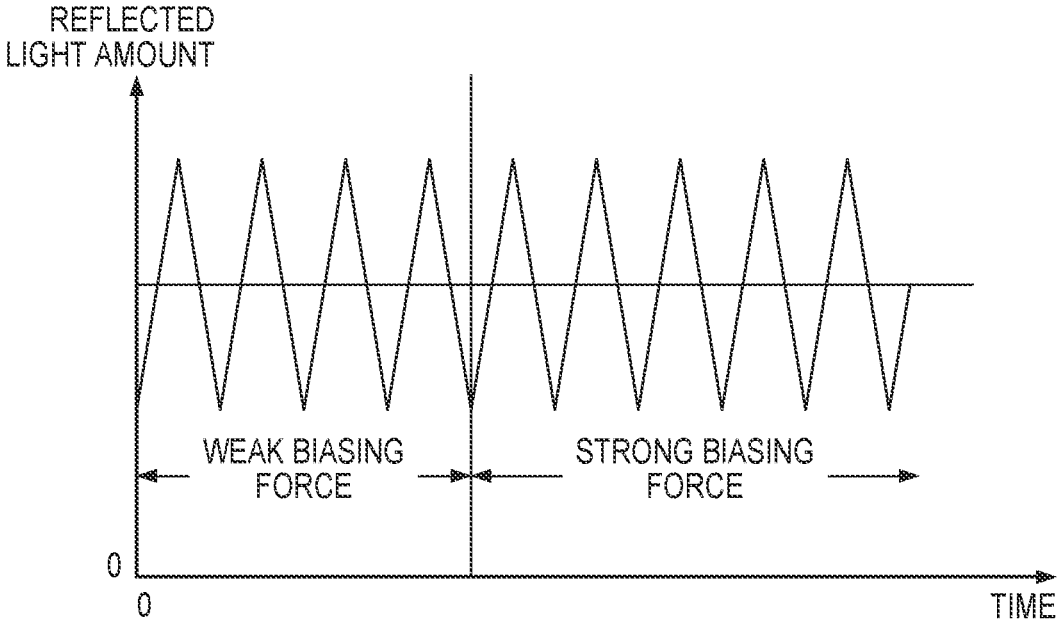
FIGS. 6A and 6B are views for describing a detection signal of the media sensor.

FIG. 6A illustrates change of a reflected light amount obtained by the photodiode 401 when the sheet P is the thin paper P1. The abscissa indicates time and the ordinate indicates a reflected light amount. When sheet P is the thin paper P1, the sheet P is stably conveyed following the guide portion 403, irrespective of the biasing force. Therefore, change is not seen in a reflected light amount with respect to change of the biasing force.

Figure 6B:
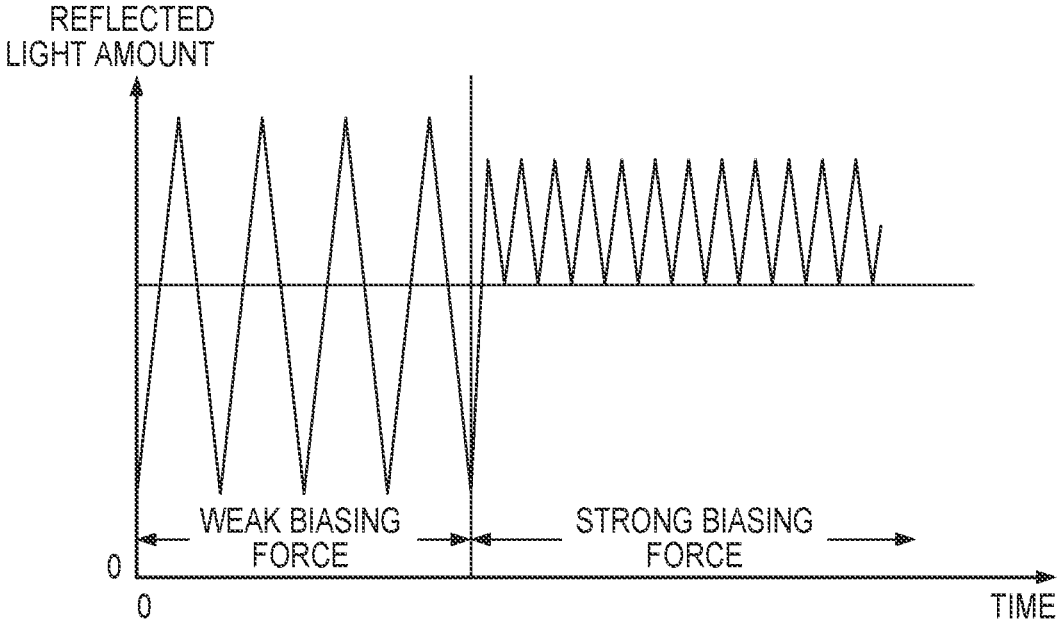

FIG. 6B illustrates a reflected light amount obtained by the photodiode 401 when the sheet P is the thick paper P2. When the sheet P is the thick paper P2, the sheet P is not stably conveyed following the guide portion 403 in a period when the biasing force is weak. Meanwhile, the sheet P is stably conveyed in a period when the biasing force is strong. Therefore, change also occurs in a reflected light amount with respect to change of the biasing force.

The photodiode 401 of the media sensor 123 outputs a signal (an output value) in accordance with the reflected light amount. The CPU 200 receives the reflected light amount (output value) obtained by the media sensor 123. The CPU 200 calculates the grammage of the sheet P from a manner of the change of the reflected light amount when the biasing force of the spring 402 is caused to change. For example, the CPU 200 may obtain a difference between an average value of the reflected light amount when the biasing force is weak and an average value of the reflected light amount when the biasing force is strong, and use a table or function to convert the difference to a grammage. The table or function for converting the difference to a grammage may be stored in the ROM 201. The CPU 200 determines a type of sheets P from the calculated grammage value.

<Method of Determining Sheet Type from Grammage; Detection Variation>

Figure 7:
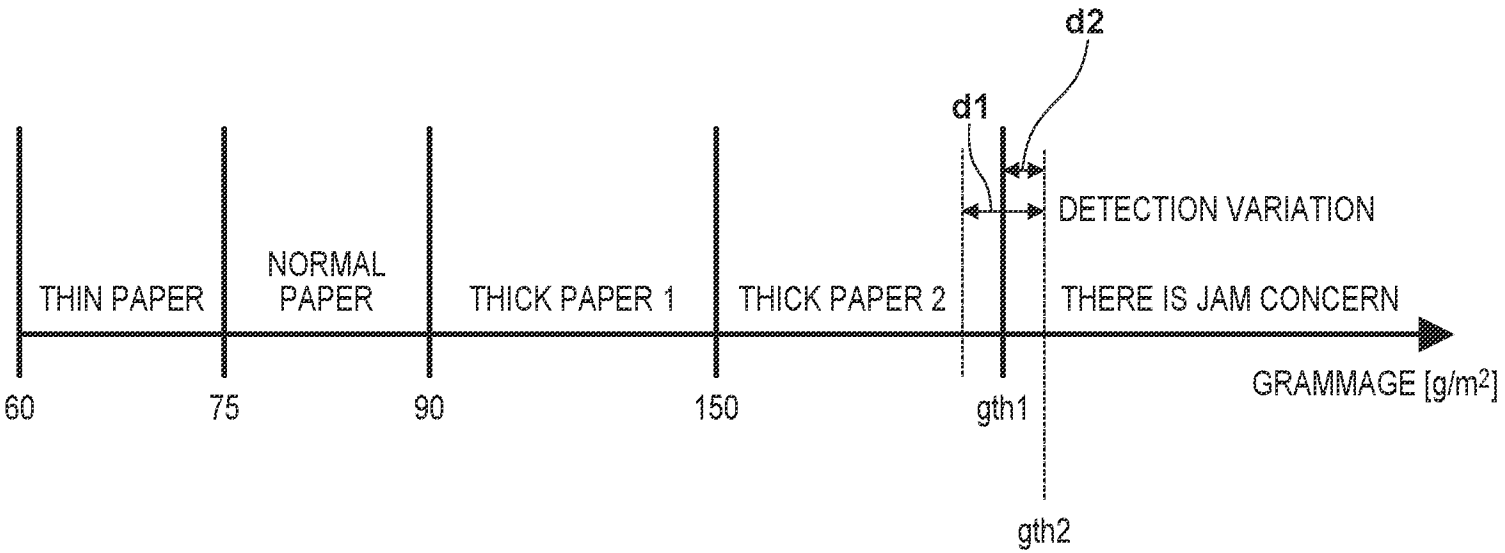
FIG. 7 is a view for describing a method in which a type of a sheet is determined.

FIG. 7 indicates an association relationship between grammages and types of the sheet P. The abscissa indicates the grammage of a sheet P. The grammage and type of the sheet P indicated in FIG. 7 are both merely examples. The CPU 200 determines the type of the sheet P by comparing the grammage with a threshold value. Here, four types that can be conveyed: thin paper/normal paper/thick paper 1/thick paper 2 are exemplified. If the grammage exceeds 60 [g/m] and is less than or equal to 75 [g/m], the CPU 200 determines the type as thin paper. If the grammage exceeds 75 [g/m] and is less than or equal to 90 [g/m], the CPU 200 determines the type as normal paper. If the grammage exceeds 90 [g/m] and is less than or equal to 150 [g/m], the CPU 200 determines the type as thick paper 1. If the grammage exceeds 150 [g/m] and is less than or equal to GTH1 [g/m], the CPU 200 determines the type as thick paper 2. GTH1 is 200 [g/m], for example. Note that, because the resilience is strong for the sheet P for which the grammage exceeds 200 [g/m], there is the possibility of sheet clogging (a jam) occurring at a curved portion of the conveyance path 110.

Incidentally, there is at least detection variation in a detection result of the media sensor 123, due to various factors such as individual differences in the sheets P that are used, endurance of the image forming apparatus 1, and the environment (temperature or humidity) in which the image forming apparatus 1 is installed. For example, even with a sheet P having a grammage of exactly 200 [g/m], there are cases were the detection result is not 200 [g/m] due to various factors. In other words, a detection result varies in a range of a detection variation d1. Here it is assumed that the range of the detection variation d1 is from 190 [g/m] to 210 [g/m]. Due to the detection variation d1, there are cases where the detected grammage is 210 [g/m] at a maximum. As indicated by d2 in FIG. 7, a detection result from 201 [g/m] to 210 [g/m] is determined to have exceeded the threshold value GTH1. However, it is difficult to determine whether the actual grammage exceeds the threshold value GTH1 or whether the detection result exceeds the threshold value GTH1 due to detection variation. Accordingly, when feeding of the sheet P from the sheet feed cassette 100 is uniformly prohibited because the detection result exceeded the threshold value GTH1, feeding is prohibited even for a sheet P that can actually be fed. Accordingly, in the present embodiment, a grammage threshold value GTH2 larger than the grammage threshold value GTH1 is employed. The CPU 200 postpones prohibition of feeding of the sheet P if the detected grammage exceeds the grammage threshold value GTH1 and is less than or equal to the grammage threshold value Gth2. When several of the sheets P fed during a postponement period cause a feeding delay, the CPU 200 cancels the postponement and prohibits feeding of the sheets P from the sheet feed cassette 100.

<Flowchart>

Figure 8:
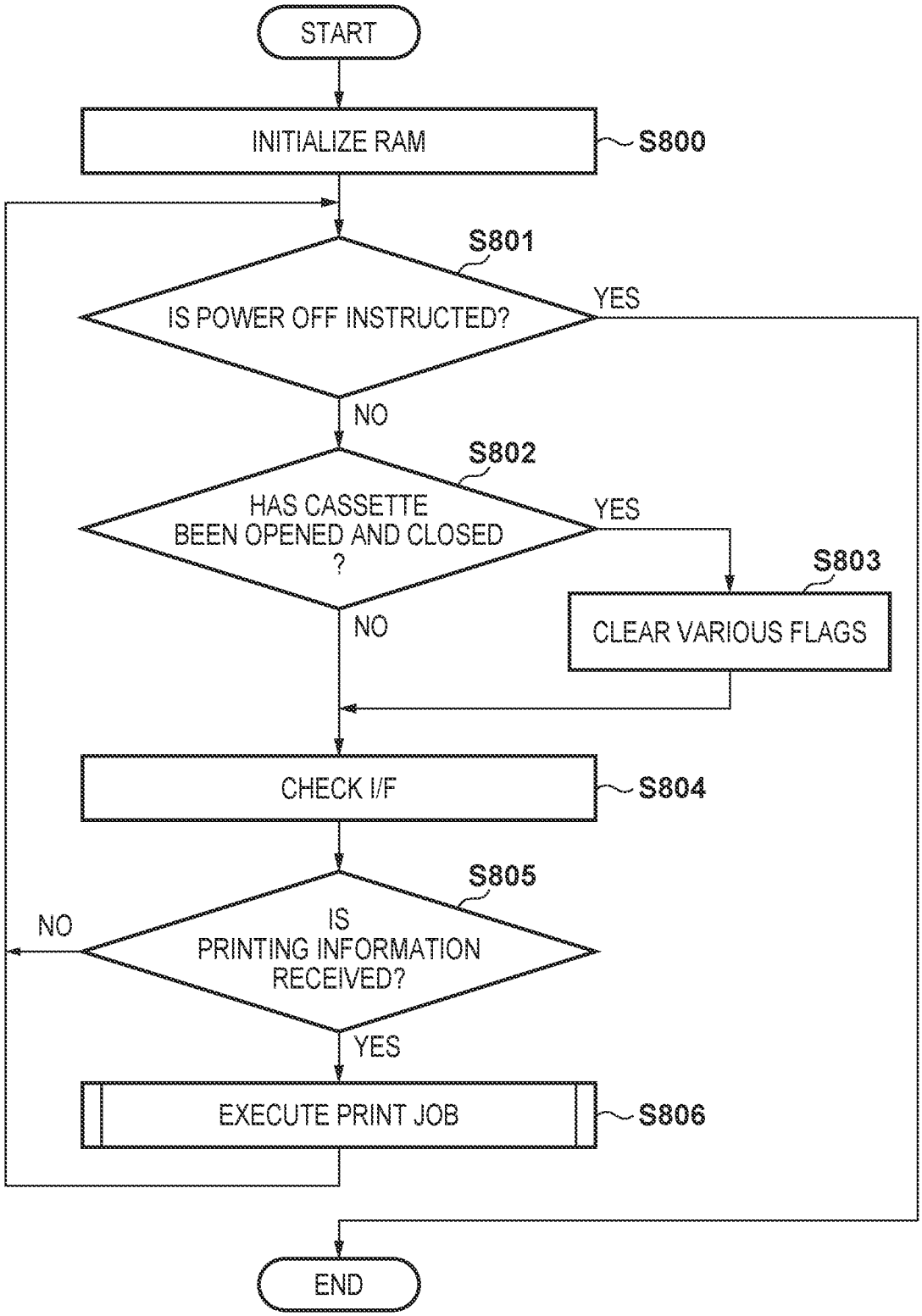
FIG. 8 is a flowchart for describing a monitoring process.

FIG. 8 is a flowchart indicating image forming processing executed by the CPU 200. When power is supplied from a commercial power supply and the CPU 200 is activated, the following processing in accordance with a control program is executed.

In step S800 the CPU 200 clears the entire contents of the RAM 202 and advances the processing to step S801.

In step S801 the CPU 200 determines whether power off has been instructed. For example, the CPU 200 determines whether the power supply switch 243 has been pressed by an operator. If the power supply switch 243 has been pressed, the CPU 200 shuts down the image forming apparatus 1. Meanwhile, if the power supply switch 243 has not been pressed, the CPU 200 advances the processing to step S802.

In step S802 the CPU 200 determines whether the sheet feed cassette 100 has been opened and closed. When the CPU 200 detects that the cassette sensor 241 entered an open state and subsequently detected that the cassette sensor 241 entered a closed state, the CPU 200 determines that the sheet feed cassette 100 was opened and closed, and advances the processing to step S803. If the sheet feed cassette 100 is not opened and closed, the CPU 200 skips step S803 and advances the processing to step S804.

In step S803 the CPU 200 clears various flags stored in the RAM 202 and then advances the processing to step S804. The various flags are a prohibition flag for managing whether to prohibit feeding of a sheet P from the sheet feed cassette 100, and a postponement flag (a grey flag) for managing whether prohibition is being postponed.

In step S804, the CPU 200 attempts obtainment of received information by checking the I/F 211, and advances the processing to step S805.

In step S805 the CPU 200 determines whether the printing information 300 from the external device 210 has been received by the I/F 211. When the printing information 300 has not been received, the CPU 200 returns the processing to step S801. Meanwhile, when the printing information 300 has been received, the CPU 200 advances the processing to step S806.

In step S806, the CPU 200 executes a print job based on the printing information 300 received from the external device 210. When the print job ends, the CPU 200 returns the processing to step S801.

<Execution of Print Job>

Figure 9A:
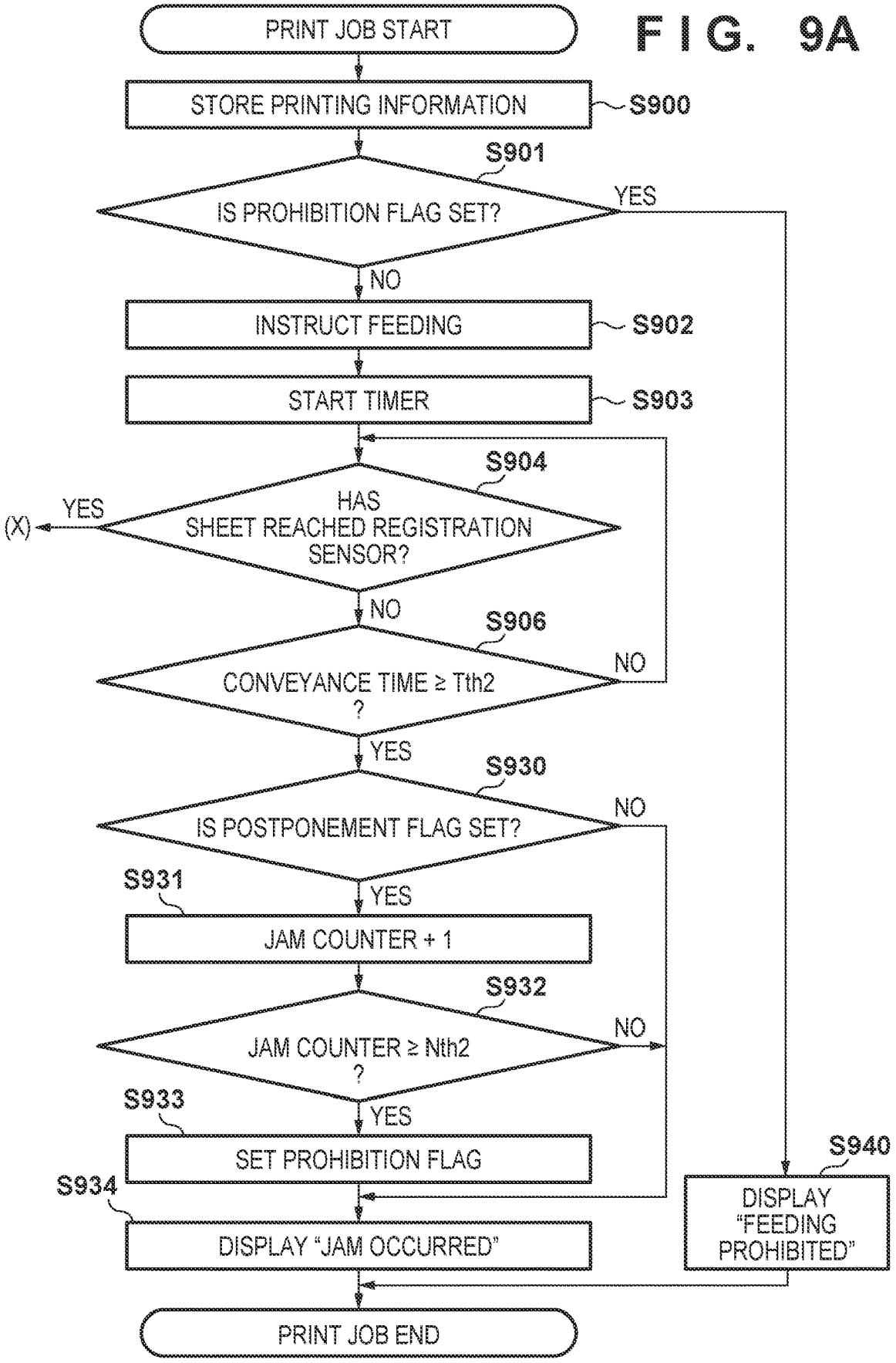
FIG. 9A is a flowchart for describing a print job.
Figure 9B:
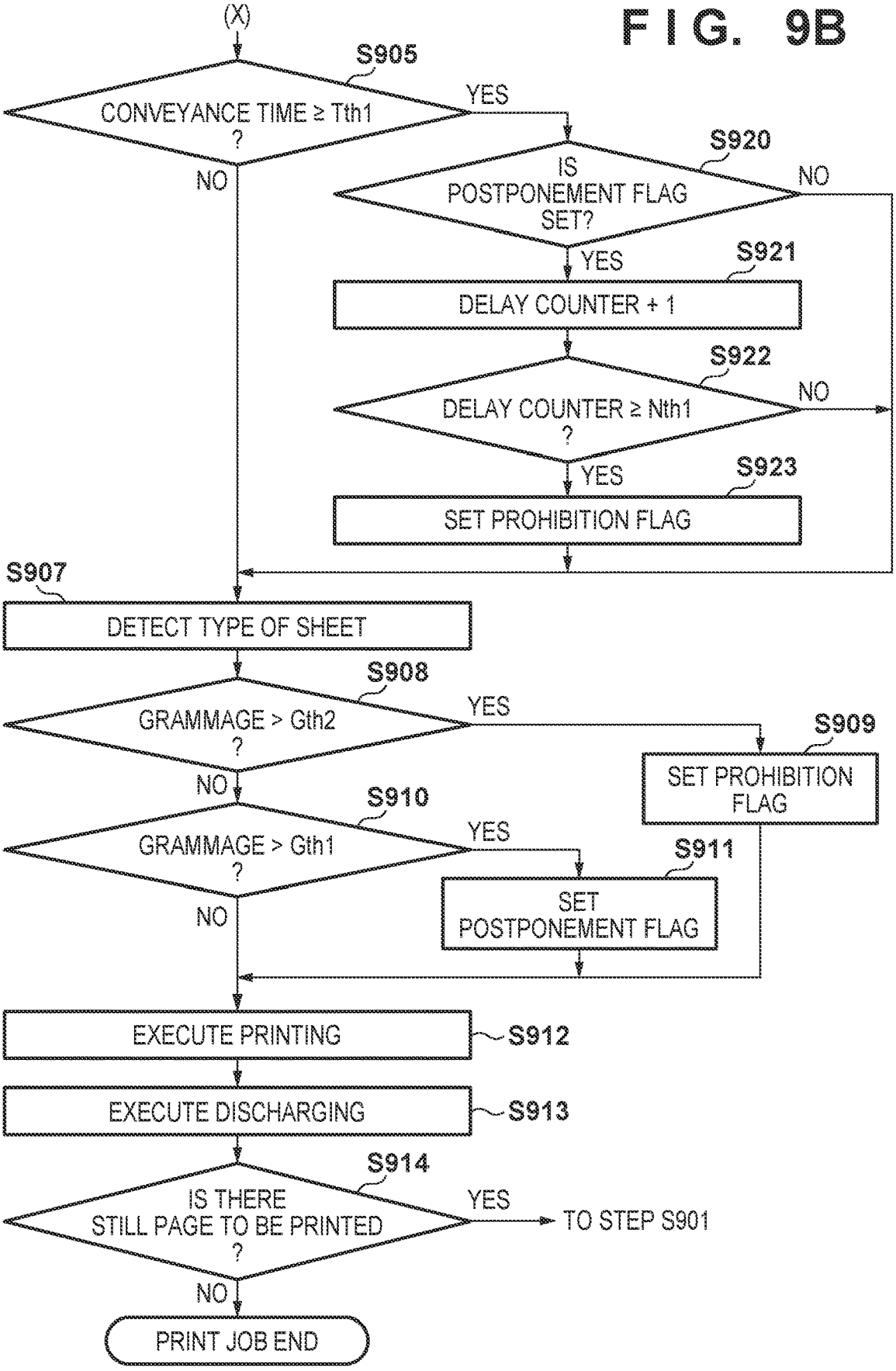
FIG. 9B is a flowchart for describing a print job.
Figure 10:
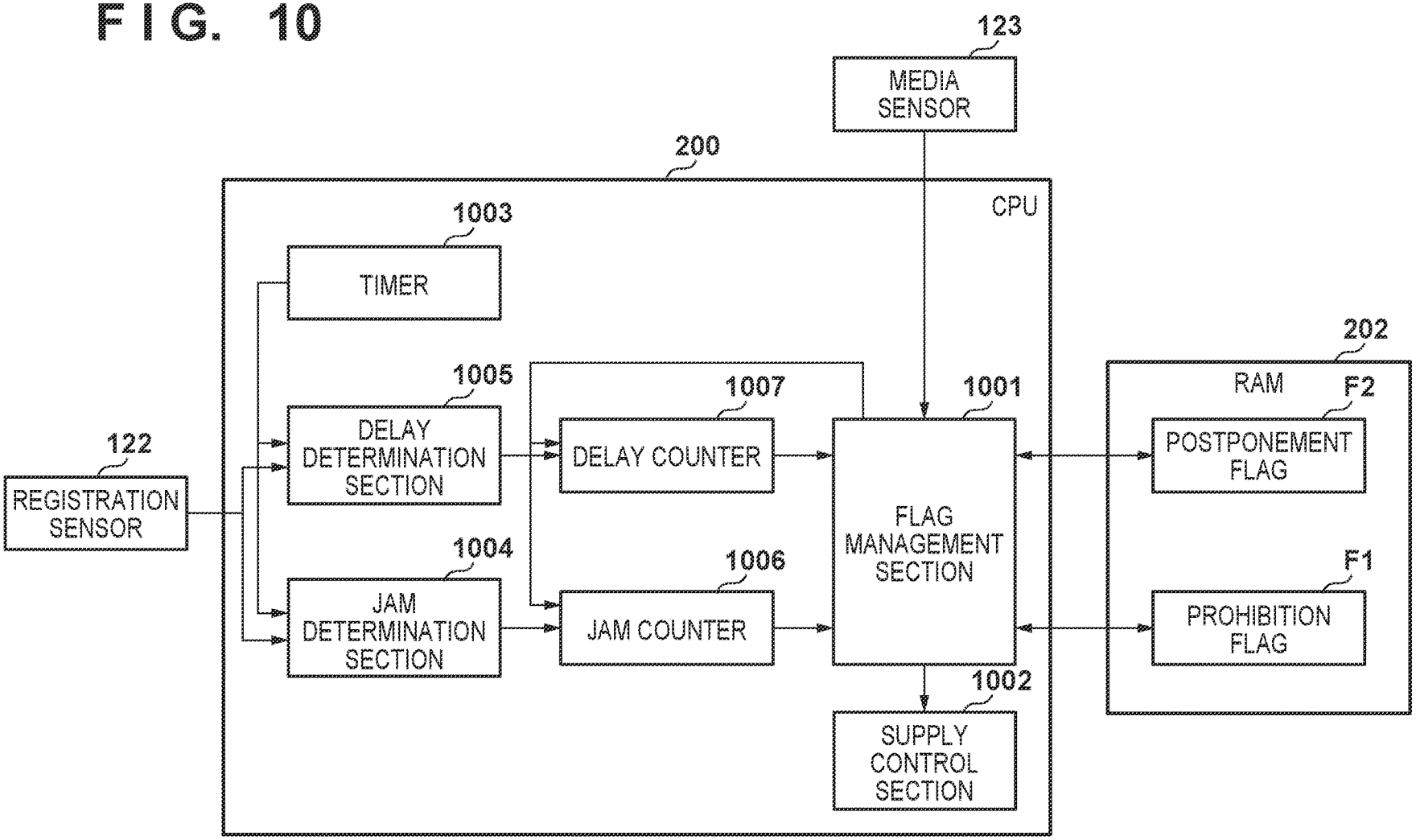
FIG. 10 is a view for describing a function of a CPU.

FIG. 9A and FIG. 9B are flowcharts indicating details of a print job executed by the CPU 200. The print job is processing that corresponds to step S806. FIG. 10 indicates functions realized by the CPU 200 executing a control program. The CPU 200 is configured by at least one processor. Description is also given below for functions of the CPU 200 together with each step of the print job. In the present embodiment, when a grammage inside the postponement range d2 is detected, a conveyance delay and a jam are monitored for. In other words, the CPU 200 not does immediately prohibit feeding of a sheet whose grammage is detected inside the postponement range d2, but postpones prohibition. The CPU 200 determines whether to prohibit feeding after all based on a result of monitoring. Here a print job is explained following a concrete example of the printing information 300. It is assumed that the printing information 300 for forming images on four pages of the sheets P is received.

First Page

In step S900 the CPU 200 stores the printing information 300 received from the external device 210 in the RAM 202, and advances the processing to step S901. Hereinafter, the CPU 200 reads the printing information 300 from the RAM 202 as necessary.

In step S901 the CPU 200 (a flag management section 1001) determines whether a prohibition flag F1 is set in the RAM 202. The prohibition flag F1 is a flag indicating whether to prohibit feeding of the sheets P from the sheet feed cassette 100. The prohibition flag F1 being set indicates that feeding is prohibited, and the prohibition flag F1 being clear indicates that feeding is not prohibited (is permitted). If the prohibition flag F1 is not set, the CPU 200 advances the processing to step S902.

In step S902 the CPU 200 (a supply control section 1002) makes an instruction to the conveyance unit 230 for feeding in order to print the first page. The conveyance unit 230 controls a driving source such as a motor or a solenoid, causes the pickup roller 102 to rotate, and feeds a sheet P from the sheet feed cassette 100, and the processing advances to step S903.

In step S903 the CPU 200 starts a timer 1003 for measuring a conveyance time, and advances the processing to step S904. The conveyance time is elapsed time starting from a timing when the CPU 200 instructed the conveyance unit 230 for feeding.

Here, it is assumed that a sheet P whose grammage is approximately 203 [g/m] is contained in the sheet feed cassette 100. As illustrated in FIG. 7, because 203 [g/m] exceeds the grammage threshold value GTH1, there is concern that a jam in a sheet feeding unit will occur. The sheet feeding unit is a portion that includes the pickup roller 102, the separation roller 103, or the like out of the conveyance path 110. Because there is a curved portion in the conveyance path 110 near the sheet feeding unit, a jam of the sheet P may occur.

In step S904 the CPU 200 determines whether a leading edge of the sheet P has reached the registration sensor 122. If a detection signal of the registration sensor 122 is not at an off level, the CPU 200 advances the processing to step S906.

In step S906 the CPU 200 (a jam determination section 1004) determines whether the conveyance time measured by the timer 1003 is greater than or equal to a jam threshold value Tth2. The jam threshold value Tth2 is 800 [ms], for example, and is a threshold value for determining the occurrence of a jam in the sheet feeding unit. If the conveyance time is not greater than or equal to the jam threshold value Tth2, the CPU 200 returns the processing to step S904. Meanwhile, if the leading edge of the sheet P has not reached the registration sensor 122 even though the conveyance time is greater than or equal to the jam threshold value Tth2, the CPU 200 advances the processing to step S930. Meanwhile, if the detection signal of the registration sensor 122 is at an on level in step S904, it is determined that the leading edge of the sheet P has reached the registration sensor 122, and the CPU 200 advances the processing to step S905.

In step S905 the CPU 200 (a delay determination section 1005) determines whether the conveyance time is greater than or equal to a delay threshold value Tth1. The delay threshold value Tth1 is 600 [ms], for example, and is a time threshold value for an estimate of a feeding delay. If the conveyance time is less than the delay threshold value Tth1, the CPU 200 advances the processing to step S907.

In step S907 the CPU 200 determines the type of sheets P based on the detection signal by the media sensor 123, and advances the processing to step S908. As described by using FIGS. 6A and 6B, the CPU 200 determines the grammage of the sheet P from the detection signal by the media sensor 123. Note that the CPU 200 may determine whether an auto-detect mode has been designated in accordance with the print mode 302 of the printing information 300. If the auto-detect mode is designated, the CPU 200 determines the type of the sheet P based on the grammage of the sheet P. Furthermore, the CPU 200 reads from the ROM 201 a condition for image forming that corresponds to the type of the sheet P, and sets this condition in the image forming unit 220. For example, the CPU 200 reads from the ROM 201 a target temperature corresponding to the type of the sheet P, and controls power to input to a heater of the fixing apparatus 140 so that the temperature of the fixing apparatus 140 reaches the target temperature. In contrast, an operator may select the type of the sheet P. The CPU 200 recognizes the type of the sheet P based on type information set in the print mode 302, and sets the condition for image forming in accordance with the type of the sheet P. As an example, it is assumed that the CPU 200 detects 205 [g/m] as the grammage of the sheet P.

In step S908 the CPU 200 (the flag management section 1001) determines whether the grammage detected by the media sensor 123 exceeds the grammage threshold value Gth2. The grammage threshold value GTH2 is set to 210 [g/m], for example. If the grammage exceeds the grammage threshold value Gth2, the CPU 200 advances the processing to step S909.

In step S909 the CPU 200 sets the prohibition flag F1. For example, if the grammage is 215 [g/m], the prohibition flag F1 is set and feeding of the second and subsequent pages is prohibited. If the grammage is 205 [g/m], because the grammage does not exceed the grammage threshold value Gth2, the CPU 200 advances the processing to step S910.

In step S910 the CPU 200 (the flag management section 1001) determines whether the grammage exceeds the grammage threshold value GTH1. The grammage threshold value GTH1 is set to 200 [g/m], for example. As cases where the grammage exceeds the grammage threshold value GTH1, there is a case where the actual grammage exceeds the grammage threshold value GTH1, and a case where the actual grammage does not exceed the grammage threshold value GTH1 but there is influence by detection variation. In other words, in the present embodiment, when the grammage detected by the media sensor 123 exceeds the grammage threshold value GTH1, prohibition of feeding is postponed. In this way, when the grammage exceeds the grammage threshold value GTH1, the CPU 200 advances the processing to step S911. Here, because the grammage of the sheet P is 205 [g/m], the CPU 200 advances the processing to step S911.

In step S911 the CPU 200 (the flag management section 1001) sets a postponement flag F2. The postponement flag F2 being set indicates that prohibition of feeding is being postponed, and the postponement flag F2 being clear indicates that prohibition of feeding is not being postponed.

In step S912 the CPU 200 (the supply control section 1002) prints an image to the sheet P by the image forming unit 220 while continuing conveyance of the sheet P by the conveyance unit 230.

In step S913 the CPU 200 (the supply control section 1002) discharges the sheet P to the sheet discharge tray 160 in accordance with the conveyance unit 230, and advances the processing to step S914.

In step S914 the CPU 200 refers to the printing information 300 and determines whether there is still a page to be printed. When there is not a page still to be printed, the CPU 200 ends the print job. Meanwhile, when there still remains a page to be printed, the CPU 200 returns the processing to step S901, and continues print processing for the next page.

Note that there are cases where a sheet P that can be fed, as with a sheet P whose grammage is approximately 150 [g/m], is contained in the sheet feed cassette 100. In such a case, the CPU 200 advances the processing from step S908 to step S910, advances the processing from step S910 to step S912, and executes printing. The CPU 200, after discharging the sheet P in step S913, returns the processing from step S914 to step S901 to repeat a series of operations.

Second Page

When the processing is returned from step S914 to step S901 for printing of the second page, the prohibition flag F1 is not set. Consequently, the CPU 200 advances the processing from step S901 to step S902, and feeds a sheet P from the sheet feed cassette 100. In step S903 the CPU 200 starts the timer 1003 for the sheet of the second page, and advances the processing to step S904. Upon detecting in step S904 that the leading edge of the sheet P has reached the registration sensor 122, the CPU 200 advances the processing to step S905. When a measured value of the timer 1003 is greater than or equal to the delay threshold value Tth1 in step S905, the CPU 200 determines that a feeding delay (a conveyance delay) has occurred, and advances the processing to step S920.

In step S920 the CPU 200 (the flag management section 1001) reads the postponement flag F2 from the RAM 202, and determines whether the postponement flag F2 is set. When the postponement flag F2 is set, the CPU 200 advances the processing to step S921 because feeding prohibition is being postponed. If the postponement flag F2 is not set, the CPU 200 advances the processing to step S907.

In step S921 the CPU 200 (the flag management section 1001) increments the value of a delay counter 1007 by one. The delay counter 1007 is a counter for counting a number of times that a delay of a sheet P has occurred. The delay counter 1007 is only incremented when the postponement flag F2 is set. The delay counter 1007 may be realized by a counter circuit, and may be a variable allocated in the RAM 202.

In step S922 the CPU 200 (the flag management section 1001) determines whether the count value of the delay counter 1007 is greater than or equal to a predetermined number Nth1. The predetermined number Nth1 is 2, for example. If the count value of the delay counter 1007 is greater than or equal to the predetermined number Nth1, the CPU 200 advances the processing to step S923. However, in this example, the CPU 200 advances the processing to step S907 because the delay counter 1007 has not reached 2. The predetermined number Nth1 is a threshold value for a number of occurrences of a feeding delay that have occurred after the postponement flag F2 is set. In other words, the predetermined number Nth1 defines an end to postponement.

In step S907 the CPU 200 detects the type of the sheet P for the second page in accordance with the media sensor 123. If the detection result of the grammage of the sheet P for the second page is 199 [g/m], the CPU 200 advances the processing from step S908 to step S910, and further advances the processing from step S910 to step S912. Note that the CPU 200 does not clear the postponement flag F2 once set even after detecting a sheet P having a feedable grammage.

In step S912 the CPU 200 prints an image to the sheet P for the second page, discharges the sheet P to the sheet discharge tray 160 in step S913, and advances the processing to step S914. The CPU 200 returns the processing from step S914 to step S901 for printing to a sheet P of the third page.

Third Page

Here, the prohibition flag F1 is not still set. Consequently, in step S902 the CPU 200 feeds a sheet P for the third page from the sheet feed cassette 100, starts the timer 1003 in step S903, and advances the processing to step S904.

Upon detecting in step S904 that the leading edge of the sheet P has reached the registration sensor 122, the CPU 200 advances the processing to step S905.

When the timer 1003 is greater than or equal to the delay threshold value Tth1 in step S905, the CPU 200 determines that a feeding delay has occurred, and advances the processing to step S920.

In step S920, because the postponement flag F2 is set by the CPU 200, the CPU 200 advances the processing to step S921.

Step S921 the CPU 200 increments the delay counter 1007 by 1, and advances the processing to step S922.

In step S922, the CPU 200 determines that the count value of the delay counter 1007 has reached the predetermined number Nth1, and advances the processing to step S923.

In step S923 the CPU 200 (the flag management section 1001) sets the prohibition flag F1, and advances the processing to step S907.

In step S907 the CPU 200 detects the grammage of the sheet P by the media sensor 123, and advances the processing to step S908. Here it is assumed that the grammage of the sheet P for the third page is 203 [g/m]. In such a case, the CPU 200 advances the processing from step S908 to step S910, and advances the processing from step S910 to step S911.

In step S911 the CPU 200 overwrites the postponement flag F2 already set to set it again, and advances the processing to step S912.

In step S912 the CPU 200 prints an image to the sheet P for the third page, discharges the sheet P to the sheet discharge tray 160 in step S913, and advances the processing to step S914.

Fourth Page

The CPU 200 returns the processing from step S914 to step S901 for printing of the fourth page. Here, because the prohibition flag F1 is set, the CPU 200 advances the processing to step S940.

In step S940 the CPU 200 (the flag management section 1001) displays in the display unit 244 a notification indicating "feeding prohibited". FIG. 11A illustrates an example of a notification indicating "feeding prohibited". In a case where the possibility that the actual grammage of the sheet P exceeds the grammage threshold value GTH1 is high, there is a high possibility for a jam to occur in the conveyance path. In other words, when conveyance delays occur frequently during prohibition postponement, the CPU 200 determines that not only the detected grammage but also the actual grammage exceeds the grammage threshold value GTH1. Consequently, it is possible to prevent occurrence of a jam. Subsequently, the CPU 200 ends the print job.

In this way, the CPU 200 (the supply control section 1002) postpones prohibition of feeding even after detecting a sheet P that could cause a jam to occur in the media sensor 123. When a predetermined number of feeding delays or more occurs in a postponement period, the CPU 200 (the supply control section 1002) cancels postponement to execute prohibition of feeding. Accordingly, in the case of a sheet P that does not cause a feeding delay to occur, feeding and image formation are executed even if the sheet P could cause a jam to occur. Consequently, prohibition of feeding due to detection variation of the media sensor 123 should be suppressed.

<Jam Occurrence>

Description is given below for processing when a jam has occurred during prohibition postponement. Here, as a concrete example, it is assumed that the CPU 200 has received two pages worth of the printing information 300. Here the actual grammage of a sheet P for the first page is 208 [g/m], but it is assumed that a detection result therefor is 205 [g/m].

First Page

In step S900 the CPU 200 stores the printing information in the RAM 202. In step S901, because the prohibition flag F1 is not set, the CPU 200 advances the processing to step S902.

In step S902 a sheet P is fed from the sheet feed cassette 100 for printing of the first page.

In step S903 the CPU 200 starts counting by the timer 1003.

Upon detecting in step S904 that the leading edge of the sheet P has reached the registration sensor 122, the CPU 200 advances the processing to step S905.

In step S905 if the timer 1003 has not reached the delay threshold value Tth1, the CPU 200 advances the processing to step S907.

In step S907 the CPU 200 detects the grammage of the sheet P in accordance with the media sensor 123 (example: 205 [g/m]), and advances the processing to step S908. The CPU 200 advances the processing from step S908 to step S910, and advances the processing from step S908 to step S911.

In step S911 the CPU 200 sets the postponement flag F2, and advances the processing to step S912.

In step S912 the CPU 200 prints an image to the sheet P, discharges the sheet P to the sheet discharge tray 160 in step S913, and advances the processing to step S914.

Second Page

The CPU 200 returns the processing from step S914 to step S901 for printing of the second page. Here, because the prohibition flag F1 is not set, the CPU 200 advances the processing to step S902.

In step S902 the CPU 200 feeds a sheet P for the second page from the sheet feed cassette 100, and advances the processing to step S903.

In step S903 the CPU 200 starts counting by the timer 1003, and advances the processing to step S904. Here, for convenience of description, it is assumed that the count value of the timer 1003 has reached the jam threshold value Tth2 in step S906 before it is detected in step S904 that the leading edge of the sheet P reaches the registration sensor 122. In such a case the CPU 200 advances the processing to step S930.

In step S930 the CPU 200 (the flag management section 1001) determines whether the postponement flag F2 is set. In this example, because the postponement flag F2 is set for the first page, the CPU 200 advances the processing to step S931.

In step S931 the CPU 200 (the flag management section 1001) increments a jam counter 1006 by 1, and advances the processing to step S932. The jam counter 1006 is a counter for counting a number of jams that have occurred in the postponement period. The jam counter 1006 may be realized by a counter circuit, and may be a variable allocated in the RAM 202.

In step S932 the CPU 200 (the flag management section 1001) determines whether the jam counter 1006 is greater than or equal to a predetermined number Nth2. The predetermined number Nth2 is set to 1, for example. If the jam counter 1006 is greater than or equal to the predetermined number Nth2, the CPU 200 advances the processing to step S933.

In step S933 the CPU 200 (the flag management section 1001) sets the prohibition flag F1, and advances the processing to step S934.

In step S934 the CPU 200 displays on the display unit 244 a notification indicating that a jam has occurred, and ends the print job.

FIG. 11B illustrates a notification indicating that a jam has occurred. An operator notices the occurrence of the jam by viewing the notification displayed on the display unit 244. An operator opens the maintenance door 180 provided in the image forming apparatus 1 to remove the sheet P for the second page that jammed, and closes the maintenance door 180. The CPU 200 recognizes the opening and closing of the maintenance door 180 based on a detection result by the door sensor 242, and the CPU 200 requests the external device 210 for a retransmission of the printing information 300 for the second page. The external device 210 transmits the printing information 300 for the second page again. The CPU 200 executes a print job indicated in FIG. 9A and FIG. 9B in accordance with this printing information 300. In step S900 the CPU 200 stores the printing information in the RAM 202. In step S901 the CPU 200 (the flag management section 1001) advances the processing to step S940 because the prohibition flag F1 is set. In step S940 the CPU 200 displays on the display unit 244 a notification indicating that feeding is prohibited, and ends the print job. Note that the CPU 200 (the flag management section 1001) may clear the prohibition flag F1 upon detecting opening and closing of the sheet feed cassette 100 in accordance with the cassette sensor 241. This is because there is the possibility that the sheets P have been removed from the sheet feed cassette 100 by an operator, and sheets P of a different type are contained in the sheet feed cassette 100.

In this way, upon detecting a predetermined number or more of jams during postponement of feeding prohibition, the CPU 200 prohibits feeding of the sheets P. Consequently, it is possible to prevent occurrence of a jam. Meanwhile, the CPU 200 continues the print job if less than the predetermined number of jams have occurred during postponement of feeding prohibition. Accordingly, printing is continued for a sheet P having a low probability for the occurrence of a jam, despite the grammage of the sheet P being close to a grammage for which feeding should be prohibited.

<Sheet P Having High Probability for Jam to Occur>

As described in relation to step S909, when a grammage measured by the media sensor 123 (example: 215 [g/m]) exceeds the grammage threshold value Gth2, in step S909 the CPU 200 sets the prohibition flag F1. Accordingly, the CPU 200 advances from step S901 to step S940 for a subsequent sheet P, and prohibits feeding. Consequently, feeding is prohibited for a sheet P having a high possibility for a jam to occur irrespective of detection variation. By this occurrence of a jam is suppressed.

<Summary>

The sheet feed cassette 100 as described using FIG. 1 is an example of a container for containing the sheets P. A manual feed tray or the like may be employed instead of the sheet feed cassette 100. The pickup roller 102 and the like are an example of a supplier device for supplying a sheet P contained in the sheet feed cassette 100 to the conveyance path 110. The registration roller 121 and the like are an example of a conveyor for conveying the sheet P in the conveyance path 110 from an upstream side to a downstream side. The media sensor 123 is an example of a detector for detecting a property parameter that influences conveyance accuracy of the sheet P and is a property parameter of the sheet P conveyed in the conveyance path 110. Note that the property parameter is a grammage, a thickness, or the like of the sheet P, for example. In other words, the media sensor 123 is an example of a grammage detector for detecting the grammage of a sheet conveyed in the conveyance path 110. As described in relation to step S908, the supply control section 1002 prohibits supply of a sheet P from the sheet feed cassette 100 in a case where the property parameter exceeds a second threshold value larger than a first threshold value. The grammage threshold value Gth1 is an example of the first threshold value. The grammage threshold value Gth2 is an example of the second threshold value. As described in relation to step S910, the supply control section 1002 postpones prohibition of supply of a sheet P from the sheet feed cassette 100 in a case where the property parameter exceeds the first threshold value and is less than or equal to the second threshold value. The supply control section 1002 permits supply of a sheet from the sheet feed cassette 100 if the property parameter is less than or equal to the first threshold value. The delay determination section 1005 is an example of a delay determiner for determining a conveyance delay of a sheet P based on a conveyance time of the sheet P. The delay counter 1007 is an example of a delay counter for counting a number of occurrences of a conveyance delay in a state where prohibition of supply of the sheets P is being postponed. The CPU 200 is an example of a controller for controlling a condition for image forming in the image forming unit 220 in accordance with a type of a sheet P or a property parameter such as grammage. The image forming unit 220 is an example of an image former for forming an image on a sheet P in a case where supply of the sheet P is not prohibited. The supply control section 1002 prohibits supply of the sheets P in a case where a number of occurrences of a conveyance delay is greater than or equal to a predetermined number in a state where prohibition of supply of the sheets P is being postponed. In this way, in a case where there is concern over a jam of a sheet P due to the influence of detection variation of the media sensor 123, prohibition of feeding for subsequent sheets P is postponed. In addition, in a case where conveyance delays frequently occur for subsequent sheets P, feeding of the sheets P from the sheet feed cassette 100 is prohibited. In this way, by introducing postponement of feeding prohibition, accuracy of feeding for control of the sheets P in accordance with the type of the sheets P improves.

Note that the flag management section 1001 is an example of a setter for setting a flag in a case where the property parameter exceeds the first threshold value. The flag may be one bit of data. The flag management section 1001 is an example of a setter for setting a flag in a case where the grammage exceeds a first grammage. The grammage threshold value GTH1 is an example of the first threshold value or the first grammage. The postponement flag F2 is an example of a flag. The registration sensor 122 is an example of a sheet detector for detecting a sheet P at a predetermined position in the conveyance path. The timer 1003 is an example of a measurer for measuring a conveyance time of a sheet P to the registration sensor 122. The delay determination section 1005 may determine a conveyance delay of a sheet P based on whether a conveyance time is greater than or equal to a first amount of time. The delay threshold value Tth1 is an example of the first amount of time. The delay counter 1007 is an example of a delay counter for counting a number of occurrences of a conveyance delay in a state where a flag is set. The supply control section 1002 is an example of a prohibitor for prohibiting supply of sheets from the sheet feed cassette 100 in a case where the property parameter exceeds the second threshold value which is larger than the first threshold value or in a case where the number of occurrences of a conveyance delay is greater than or equal to a threshold value. The supply control section 1002 is an example of a prohibitor for prohibiting supply of sheets P from the sheet feed cassette 100 in a case where the grammage exceeds the second grammage larger than the first grammage or in a case where the number of occurrences of a conveyance delay is greater than or equal to a threshold value.

The jam determination section 1004 is an example of a determiner for determining a jam of a sheet P based on whether a conveyance time is greater than or equal to a second amount of time that is longer than the first amount of time. Note that the jam threshold value Tth2 explained in relation to step S906 is an example of the second amount of time. The jam counter 1006 is an example of a jam counter for counting a number of jam occurrences. The supply control section 1002 is an example of a prohibitor for prohibiting supply of sheets P from the sheet feed cassette 100 in a case where a number of occurrences of a jam is greater than or equal to a predetermined number. Nth2 described in relation to step S932 is an example of the predetermined number. As described using FIG. 9A, the jam counter 1006 may be configured to count a number of occurrences of a jam in a state where the postponement flag F2 is set.

The registration sensor 122 is an example of a sheet detector for detecting a sheet P conveyed by the conveyance unit 230 and arranged in the conveyance path 110 on an upstream side of the secondary transfer unit 130 of the image forming unit. The delay determination section 1005 may determine a conveyance delay of a sheet based on whether a conveyance time is greater than or equal to a first amount of time. The conveyance time is an amount of time that is measured from when a sheet P is supplied by the pickup roller 102 until when the sheet P is detected by the registration sensor 122.

The timer 1003 may start measurement of the conveyance time after resetting the conveyance time when supply of a sheet P to the conveyance unit 230 is instructed. By this, it is possible to measure a conveyance time for each sheet P by one timer.

The display unit 244 is an example of an outputter for outputting a notification indicating that a jam has occurred. The display unit 244 is an example of an outputter for outputting a notification indicating that supply of the sheets P is prohibited. In this way the display unit 244 functions as a notifier.

As described using FIG. 7, GTH2 which is an example of a second grammage may be a lower limit grammage of a sheet P for which supply by the pickup roller 102 of the conveyance unit 230 is prohibited. In addition, GTH1 which is an example of a first grammage may be an upper limit grammage of a sheet P for which supply by the pickup roller 102 is permitted. In addition a difference between the second grammage and the first grammage may be defined based on detection variation by the media sensor 123. By this, prohibition of feeding is postponed in a case where a grammage detected by the media sensor 123 exceeds the first grammage and is less than or equal to the second grammage. This is because there is a possibility of an influence from detection variation mixing in for such a grammage.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-056460, filed Mar. 22, 2017, which is hereby incorporated by reference herein in its entirety.

What is claimed is:

1. An image forming apparatus comprising:

a container configured to contain sheets;

a supplier configured to supply a sheet contained in the container to a conveyance path;

a conveyor configured to convey the sheet in the conveyance path;

a grammage detector configured to detect a grammage of the sheet conveyed in the conveyance path;

a sheet detector configured to detect the sheet at a predetermined position in the conveyance path;

an image former configured to form an image on the sheet; and at least one processor, wherein the at least one processor includes:

a function for setting a flag in a case where the grammage detected by the grammage detector exceeds a first grammage, a function for measuring a conveyance time of the sheet to the sheet detector, a function for determining a conveyance delay of the sheet based on whether the conveyance time is greater than or equal to a first amount of time, a function for counting a number of occurrences of the conveyance delay in a state where the grammage detected by the grammage detector exceeds the first grammage, and a function for prohibiting supply of sheets from the container when the grammage exceeds a second grammage larger than the first grammage or the number of occurrences of the conveyance delay is greater than or equal to a threshold value.

2. The image forming apparatus according to claim 1, wherein the at least one processor further includes:

a function for detecting a jam of the sheet based on whether the conveyance time is greater than or equal to a second amount of time longer than the first amount of time, and a function for counting a number of occurrences of the jam, and a function for prohibiting supply of sheets from the container in a case where the grammage exceeds the second grammage, the number of occurrences of the conveyance delay is greater than or equal to the threshold value, or the number of occurrences of the jam is greater than or equal to a predetermined number.

3. The image forming apparatus according to claim 2, further comprising a notifier configured to notify information, wherein the at least one processor, upon detecting a jam of a sheet, causes the notifier to perform a notification indicating occurrence of the jam.

4. The image forming apparatus according to claim 2, wherein the at least one processor is configured to count the number of occurrences of the jam in the state where the grammage detected by the grammage detector exceeds the first grammage.

5. The image forming apparatus according to claim 1, wherein the sheet detector is arranged on an upstream side from the image former in a conveyance direction of the sheet, and the at least one processor determines the conveyance delay of a sheet based on whether the conveyance time measured from when the sheet is supplied by the supplier until the sheet detector detects the sheet is greater than or equal to the first amount of time.

6. The image forming apparatus according to claim 1, wherein the at least one processor starts measuring the conveyance time after resetting the conveyance time when supplying a sheet is instructed to the supplier.

7. The image forming apparatus according to claim 1, further comprising a notifier configured to notify information, wherein the at least one processor, upon prohibiting supply of the sheets, causes the notifier to perform a notification indicating that supply of the sheets is prohibited.

8. The image forming apparatus according to claim 1, wherein the second grammage is a lower limit grammage of a sheet for which supply by the supplier is prohibited, the first grammage is an upper limit grammage of a sheet for which supply by the supplier is permitted, and a difference between the second grammage and the first grammage is defined based on detection variation in accordance with the grammage detector.

9. The image forming apparatus according to claim 1, wherein the at least one processor controls a condition for image forming in the image former in accordance with the grammage.

10. An image forming apparatus comprising:

a container configured to contain sheets;

a supplier configured to supply a sheet contained in the container to a conveyance path;

a conveyor configured to convey the sheet in the conveyance path;

a property detector configured to detect a property parameter that influences conveyance accuracy of the sheet as the property parameter of the sheet conveyed in the conveyance path;

a sheet detector configured to detect the sheet at a predetermined position in the conveyance path; and at least one processor, wherein the at least one processor includes:

a function for measuring a conveyance time of the sheet to the sheet detector, a function for determining a conveyance delay of the sheet based on whether the conveyance time is greater than or equal to a first amount of time, a function for counting a number of occurrences of the conveyance delay in a state where the property parameter exceeds a first threshold value, and a function for prohibiting supply of sheets from the container in a case where the property parameter exceeds a second threshold value larger than the first threshold value or the number of occurrences of the conveyance delay is greater than or equal to a third threshold value.

11. An image forming apparatus comprising:

a container configured to contain sheets;

a supplier configured to supply a sheet contained in the container to a conveyance path;

a conveyor configured to convey the sheet in the conveyance path;

a property detector configured to detect a property parameter that influences conveyance accuracy of the sheet as the property parameter of the sheet conveyed in the conveyance path;

an image former configured to form an image on the sheet;

a sheet detector configured to detect the sheet at a predetermined position in the conveyance path; and at least one processor, wherein the at least one processor includes:

a function for prohibiting supply of sheets from the container in a case where the property parameter exceeds a second threshold value larger than a first threshold value, a function for permitting supply of sheets from the container in a case where the property parameter is less than or equal to the first threshold value, a function for determining a conveyance delay of the sheet based on a conveyance time of the sheet to the sheet detector, a function for counting a number of occurrences of the conveyance delay in a state where prohibition of supply of the sheets is postponed, and a function for postponing prohibition of supply of sheets from the container in a case where the property parameter exceeds the first threshold value and is less than or equal to the second threshold value, and prohibiting supply of sheets from the container in a case where the number of occurrences of the conveyance delay is greater than or equal to a predetermined number in a state where prohibition of supply of the sheets is postponed.

12. A method for controlling an image forming apparatus, the method comprising:

supplying a sheet contained in a container to a conveyance path;

conveying the sheet in the conveyance path;

detecting a grammage of the sheet conveyed in the conveyance path;

detecting the sheet by a sheet detector at a predetermined position in the conveyance path;

measuring a conveyance time of the sheet to the sheet detector;

determining a conveyance delay of the sheet based on whether the conveyance time is greater than or equal to a first amount of time;

counting a number of occurrences of the conveyance delay in a state where the grammage exceeds a first grammage; and prohibiting supply of sheets from the container in a case where the grammage exceeds a second grammage larger than the first grammage or the number of occurrences of the conveyance delay is greater than or equal to a threshold value.

* * * * *